US008720237B2

(12) United States Patent
Williams

(10) Patent No.: US 8,720,237 B2
(45) Date of Patent: May 13, 2014

(54) ROTARY LATCH

(75) Inventor: David A. Williams, Milton, FL (US)

(73) Assignee: Daws Manufacturing Company, Inc., Pensacola, FL (US)

( * ) Notice: Subject to any disclaimer, the term of this patent is extended or adjusted under 35 U.S.C. 154(b) by 201 days.

(21) Appl. No.: 13/276,727

(22) Filed: Oct. 19, 2011

(65) Prior Publication Data

US 2013/0098124 A1 Apr. 25, 2013

(51) Int. Cl.
*E05B 13/10* (2006.01)

(52) U.S. Cl.
USPC ..... 70/208; 70/215; 70/224; 292/200; 292/216; 292/336.3

(58) Field of Classification Search
USPC ..... 70/208, 210, 215, 224, 197, DIG. 31; 292/194, 200, 216, 336.3, 340, 341, 292/DIG. 31
See application file for complete search history.

(56) References Cited

U.S. PATENT DOCUMENTS

| | | | | | |
|---|---|---|---|---|---|
| 1,789,775 | A * | 1/1931 | Russ et al. | 70/485 |
| 2,358,554 | A * | 9/1944 | Bixel | 70/215 |
| 2,665,156 | A * | 1/1954 | Allen | 292/216 |
| 3,439,948 | A * | 4/1969 | Smith | 292/216 |
| 3,745,796 | A | 7/1973 | Fleming | |
| 4,134,281 | A | 1/1979 | Pelcin | |
| 4,268,077 | A | 5/1981 | Bohleen et al. | |
| 4,930,325 | A | 6/1990 | Ramsauer | |
| 5,201,557 | A | 4/1993 | Schlack | |
| 5,234,238 | A * | 8/1993 | Takimoto | 292/216 |
| 5,286,073 | A * | 2/1994 | Ui | 292/216 |
| 5,299,844 | A * | 4/1994 | Gleason | 292/240 |
| 5,450,735 | A * | 9/1995 | Esaki et al. | 70/208 |
| 5,884,948 | A * | 3/1999 | Weinerman et al. | 292/216 |
| 6,174,007 | B1 | 1/2001 | Schlack et al. | |
| 6,490,896 | B2 | 12/2002 | Segawa | |
| 6,637,785 | B2 | 10/2003 | Sugimoto | |
| 6,668,602 | B2 | 12/2003 | Graham et al. | |
| 6,719,332 | B2 * | 4/2004 | Sekulovic | 292/170 |
| 6,748,775 | B1 * | 6/2004 | Bucker et al. | 70/208 |
| 6,913,297 | B2 | 7/2005 | Jackson et al. | |
| 6,962,375 | B2 | 11/2005 | Linares | |
| 6,973,810 | B2 | 12/2005 | Chen | |
| 7,013,689 | B2 | 3/2006 | Graham et al. | |
| 7,155,947 | B2 * | 1/2007 | Bertani | 70/217 |
| 7,272,964 | B2 | 9/2007 | Graham et al. | |
| 7,320,488 | B2 * | 1/2008 | Hidding et al. | 292/216 |
| 7,497,488 | B2 | 3/2009 | Chen | |
| 8,075,027 | B2 * | 12/2011 | Zweibohmer | 292/216 |
| 2003/0025338 | A1 * | 2/2003 | Mori et al. | 292/196 |
| 2008/0047308 | A1 * | 2/2008 | Stuckey | 70/215 |
| 2010/0127513 | A1 * | 5/2010 | Akahane et al. | 292/216 |
| 2010/0171324 | A1 * | 7/2010 | Stapf | 292/336.3 |

* cited by examiner

*Primary Examiner* — Lloyd Gall
(74) *Attorney, Agent, or Firm* — GrayRobinson, PA

(57) ABSTRACT

A rotary latch mechanism is provided for securing the lid of a container in a closed position wherein a mechanical advantage is employed to facilitate latching and unlatching of a latch plate of the rotary latch mechanism.

3 Claims, 3 Drawing Sheets

FIG. 5
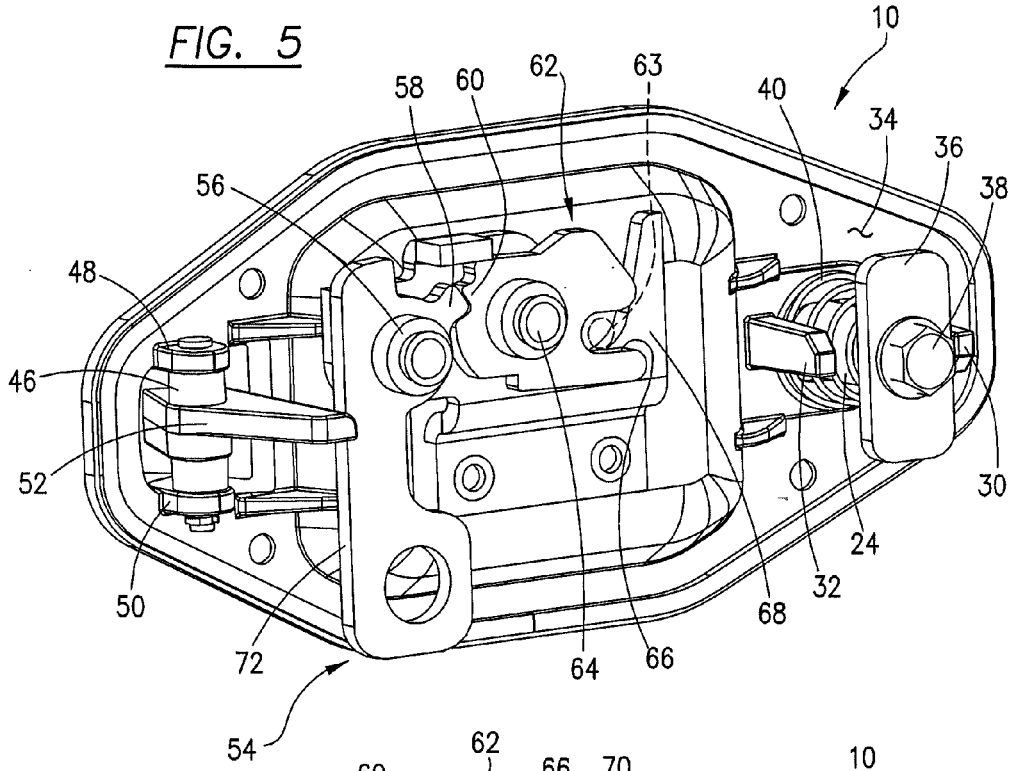
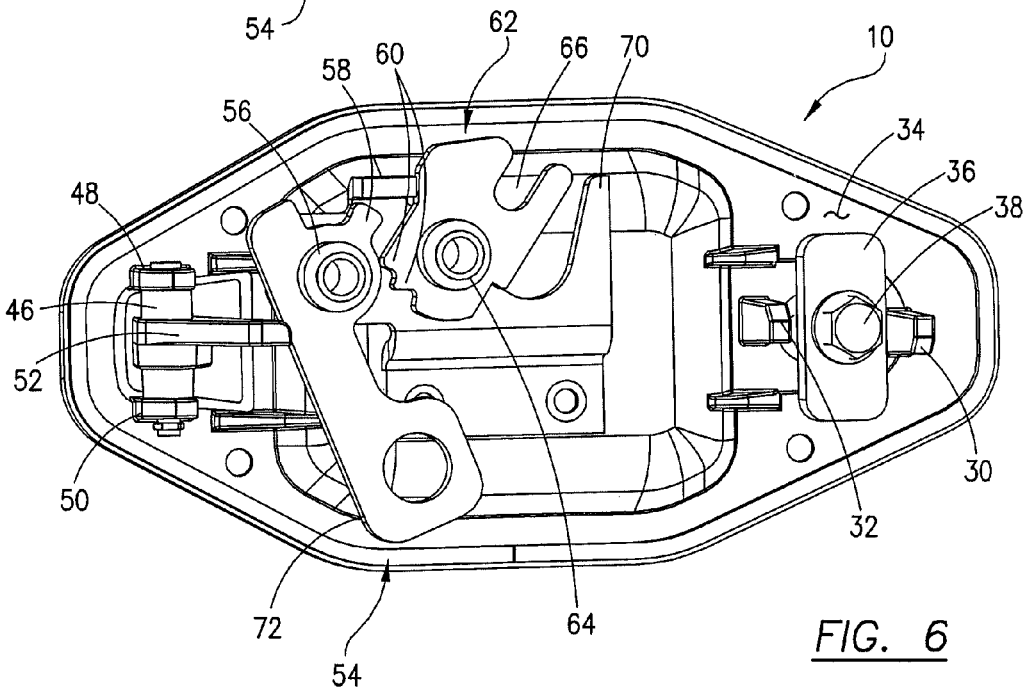
FIG. 6

ROTARY LATCH

FIELD OF THE INVENTION

This invention relates to latching mechanisms, and, more particularly, to a rotary latch for containers such as tool boxes mounted to the bed of a pickup truck.

BACKGROUND OF THE INVENTION

Rotary latches are routinely used on doors, chests, cabinets and other containers where a lid or door must be retained in a closed and/or locked position. One common type of rotary latch includes a latch plate moveable between a latched and unlatched position. When unlatched, the latch plate may receive a striker pin mounted to the lid of a toolbox, for example, as the lid is moved to a closed position. Once the lid is closed, the latch plate moves to the latched position to capture the striker pin and retain the lid in the closed position. The rotary latch may be provided with a lock to prevent the latch plate from releasing the striker pin except when unlocked.

A number of designs have been proposed in the prior art to move the latch plate from its latched position and allow the striker pin to be released. One approach is disclosed in U.S. Pat. No. 6,973,810 in which a handle mounted to the housing of a rotary latch is pivoted to set in motion a series of components that cooperate to move the latch plate to an unlatched position. In this and similar designs, a first end of the handle is pivotally mounted to the latch housing and its opposite, second end connects to one of the components that function to open the latch plate. The latch plate is opened by moving the second end of the handle to an unlatched position thus pivoting the handle about its first end. However, a substantial amount of force is required to pivot the latch handle because, as noted above, its second end is directly connected to the series of components that cooperate to open the latch plate.

SUMMARY OF THE INVENTION

This invention is directed to a rotary latch mechanism for securing the lid of a container in a closed position wherein a mechanical advantage is employed to facilitate latching and unlatching of the latch plate of the rotary latch mechanism with much less force than is required in prior art designs of the type described above.

In one presently preferred embodiment, the latch mechanism includes a latch body and a handle having a first end, and a second end coupled to a pivot pin mounted to the latch body. The pivot pin carries a pivot arm that contacts an actuator which releasably engages a latch plate operative to capture a striker pin, such as from the lid of the truck box, when the lid is closed. The first end of the handle preferably mounts a lock cylinder which is moveable between a locked and unlocked position. With the lock cylinder unlocked, the handle may be grasped and pulled outwardly so that its first end is spaced from the latch body. Such movement of the handle rotates the pivot pin connected to the second end of the handle, which, in turn, causes the pivot arm carried by the pivot pin to engage the actuator and ultimately move the latch plate to an unlatched position to receive, or to release, the striker pin.

Unlike prior art latch mechanisms of the type described above, a mechanical advantage is obtained with the rotary latch of this invention. Pulling the handle outwardly from the latch body is made easier because its first end is not connected to any components that directly or indirectly cause movement of the latch plate. Instead, the handle acts as a lever arm wherein rotation of the pivot pin coupled to the second end of the handle is created by lifting the opposite, first end of the handle. As noted above, rotation of the pivot pin, in turn, sets in motion the components operative to move the latch plate to the unlatched position.

DESCRIPTION OF THE DRAWINGS

The structure, operation and advantages of the presently preferred embodiment of this invention will become further apparent upon consideration of the following description, taken in conjunction with the accompanying drawings, wherein:

FIG. 5 is a view similar to FIG. 4 except in the unlocked position; and

FIG. 6 is a view similar to FIG. 4 except with the rotary latch in an unlatched position.

DETAILED DESCRIPTION OF THE PREFERRED EMBODIMENT

Figure 1:
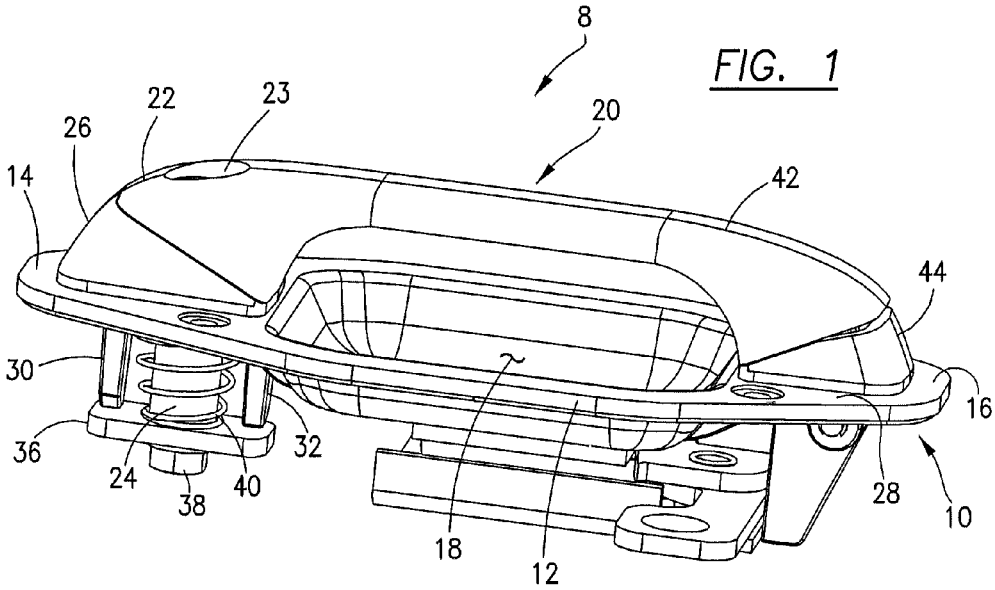
FIG. 1 is a perspective view of the rotary latch of this invention in the latched and locked position.
Figure 2:
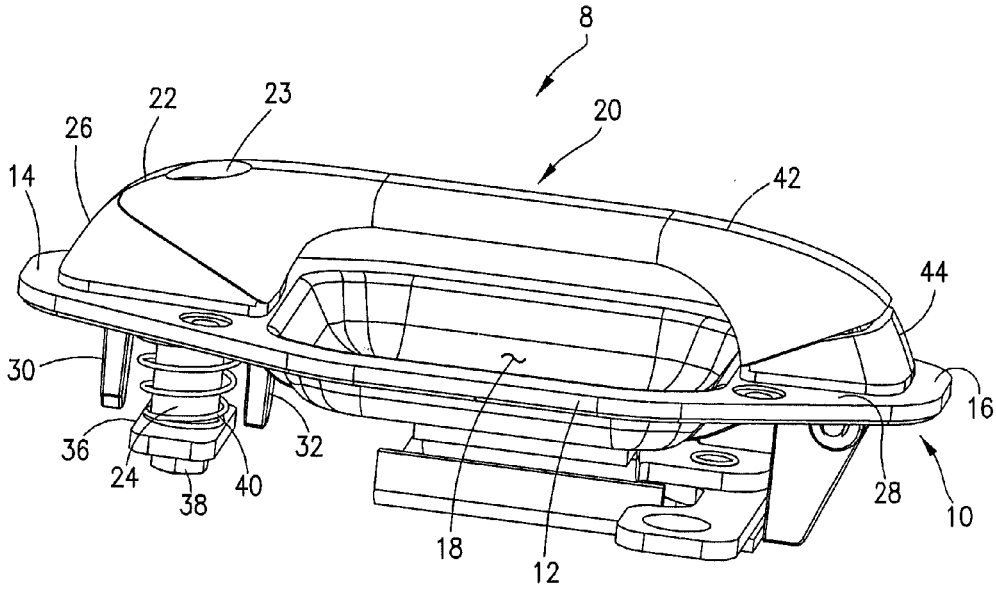
FIG. 2 is a view similar to FIG. 1, except with the rotary latch in the latched and unlocked position.

Referring now to the drawings, the rotary latch 8 of this invention comprises a latch body 10 having a center section 12 located between opposed end sections 14 and 16. The center section 12 is formed with a recess 18 to receive the fingers as one grasps a handle 20 which spans the recess 18 and extends between the two end sections 14, 16.

A first end 22 of the handle 20 is formed with a through bore 23 within which a key cylinder 24 is mounted. The first end 22 is beveled so that it engages a correspondingly beveled seat 26 mounted on the front surface 28 of the latch body 10. An opening (not shown) is formed in the latch body 10 through which the key cylinder 24 extends between spaced posts 30 and 32 each connected at one end to the rear surface 34 of the latch body 10. The inner end of the key cylinder 24 is mounted to a locking plate 36 by a bolt 38, and a coil spring 40 extends between the locking plate 36 and the rear surface 34 of the latch body 10. As described in more detail below in connection with a discussion of the operation of the rotary latch 8 of this invention, in response to operation of the key cylinder 24 the locking plate 36 is movable between a locked position shown in FIGS. 1 and 4 wherein it spans and contacts the ends of each post 30, 32, and an unlocked position depicted in FIGS. 2, 3, 5, and 6 in which the locking plate 36 is rotated approximately 90° so that it may pass between the posts 30, 32.

Figure 4:
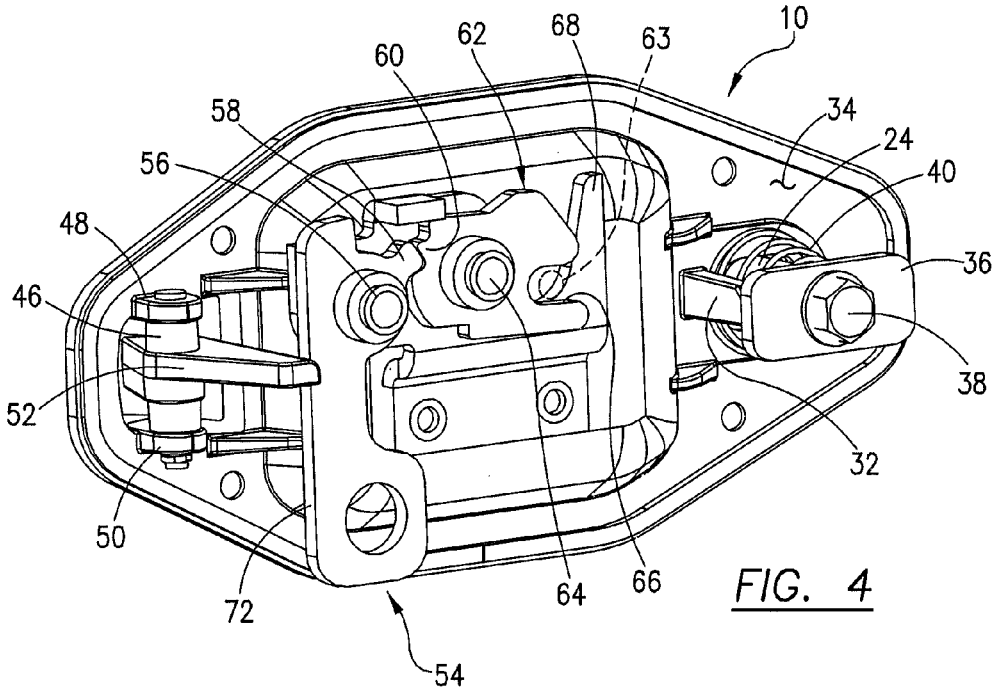
FIG. 4 is a rear view of the rotary latch in a latched and locked position.

The second end 42 of the handle 20, opposite its first end 22, is beveled to engage a second seat 44 mounted to the end section 16 of latch body 10. The second end 42 of handle 20 is coupled to a pin 46 which is pivotally mounted to an upper bearing 48 and a lower bearing 50 each connected to the rear surface 34 of the latch body 10. For purposes of the present discussion, the terms "upper," "lower," "vertically" and "laterally" refer to the orientation of the structures of the rotary latch 8 in the position depicted in the Figs. The pin 46, in turn, is fixed to a pivot arm 52 which is movable with rotation of the pin 46 relative to an actuator 54. As best seen in FIGS. 4-6, the actuator 54 is pivotally mounted on a shaft 56 connected to the rear surface 34 of the latch body 10. The upper end of the actuator 54 is preferably formed with a locking pawl 58 formed to engage one or more gear teeth 60 in a latch plate 62 which is pivotally mounted on a shaft 64 connected to the rear surface 34 of the latch body 10. The latch plate 62 is formed with a notch 66 adapted to receive a striker pin 63, shown in phantom in FIGS. 4 and 5. The striker pin 63 may be carried by the lid of a truck tool box, for example (not shown). The latch plate 62 and actuator 54 are located between a front guide plate 68, a portion of which is shown in FIG. 5, and a rear guide plate 70 a portion of which is shown in FIG. 6. Both the front and rear guide plates 68, 70 are mounted to the rear surface 34 of the latch body 10.

A spring (not shown) carried on the shaft 64 biases the latch plate 62 toward an unlatched position, illustrated in FIG. 6, wherein its notch 66 is oriented substantially vertically in position to receive or to release the striker pin 63, as described below. The actuator 54 is biased by a spring (not shown) mounted to the shaft 56 in a substantially vertical orientation, as depicted in FIG. 5. In this position, the locking pawl 58 of the actuator 54 may engage one of the gear teeth 60 on the latch plate 62 to prevent the latch plate 62 from rotating to the unlatched position shown in FIG. 6. Preferably, the pivot arm 52 rests against a side edge 72 of the actuator 54 with the latch plate 62 in the latched position.

Figure 3:
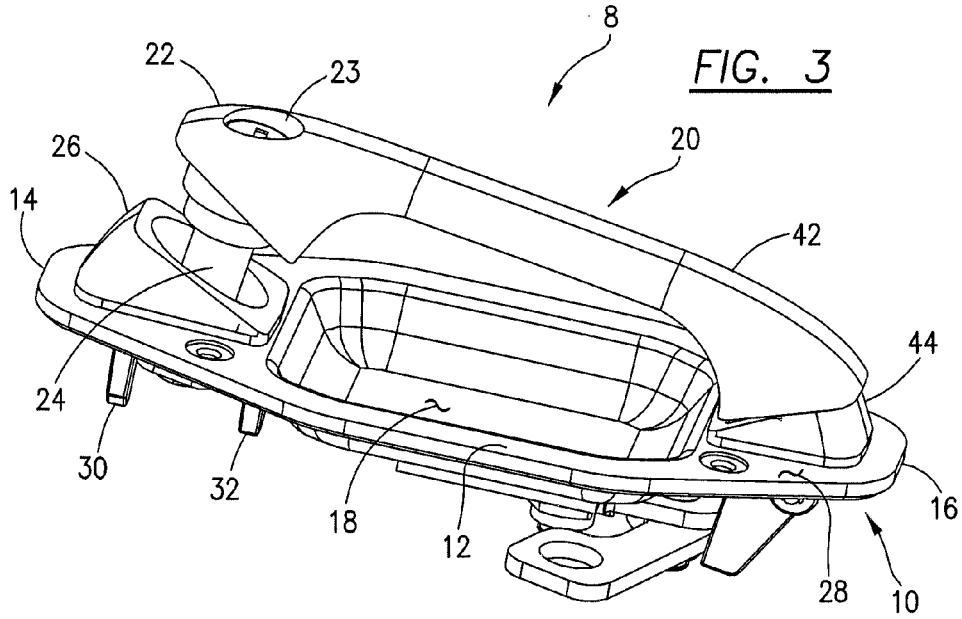
FIG. 3 is a view similar to FIGS. 1 and 2, except with the rotary latch in an unlatched position.

The rotary latch 8 of this invention operates as follows. If the key cylinder 24 is in the locked position depicted in FIGS. 1 and 4, with locking plate 36 spanning and in contact with posts 30, 32, a key (not shown) may be inserted into the key cylinder 24 to rotate it to an unlocked position illustrated in FIGS. 2 and 5. Once the key cylinder 24 is unlocked, one may grasp the handle 20 and pull its first end 22 outwardly from the front surface 28 of the latch body 10, as shown in FIG. 3, thus overcoming the force exerted by coil spring 40 on the key cylinder 24 and moving the locking plate 36 toward the rear surface 34 of the latch body 10 in between the posts 30, 32. Such movement of the first end 22 of handle 20 causes its second end 42 to rotate the pin 46 in bearings 48, 50. The pivot arm 52, which is fixed to the pin 46 and in contact with the side edge 72 of actuator 54, rotates with the pin 46 and pivots the actuator 54 in a counterclockwise direction from the position shown in FIG. 5 to that depicted in FIG. 6. In the course of such pivotal motion, the locking pawl 58 of the actuator 54 disengages a gear tooth 60 formed in the latch plate 62 which allows the spring acting on the latch plate 62 to rotate it from the latched position shown in FIG. 5 to the unlatched position illustrated in FIG. 6. When the latch plate 62 is unlatched, the striker pin 63 may be removed from the notch 66 in the latch plate 62 so that the lid or door to which the striker pin 63 is attached may be opened.

The rotary latch 8 remains in the position shown in FIG. 6, with its latch plate 62 oriented substantially vertically, until such time as the lid or door which mounts the striker pin 63 is closed. As the striker pin 63 approaches the latch plate 62, it is guided into the notch 66 therein by the front and rear guide plates 68, 70. The striker pin 63 engages the latch plate 62 and rotates it in a clockwise direction to the latched position, overcoming the spring force acting on the shaft 64 which mounts the latch plate 62 and urges it to the unlatched position. Since the actuator 54 is biased to the vertical position shown in FIG. 5, once the latch plate 62 is moved to its latched position the actuator 54 is free to rotate in the clockwise direction and assume a position wherein its locking pawl 58 contacts one of the gear teeth 60 in the latch plate 62 in order to retain the latch plate 62 in the latched position.

An important aspect of this invention is the mechanical advantage realized by the handle 20 in setting in motion the operation of pivot arm 52, actuator 54 and latch plate 62 to release the striker pin 63 from the rotary latch 8. As noted above, the first end 22 of handle 20 is pulled outwardly from the front surface 28 of the latch body 10 causing rotation of the pin 46 which is coupled to the opposite, second end 42 of the handle 20. The first end 22 of handle 20 does not directly act on the components that open the rotary latch, e.g. the pivot arm 52, actuator 54 or latch plate 62, but rather the overall length of the handle 20 is used advantageously as a lever arm to rotate pin 46. This construction greatly reduces the effort required to open the rotary latch 8 of this invention, especially compared to prior art arrangements such as described above.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A latch mechanism, comprising:

a latch body having a first surface and an opposed second surface;

a first spring-biased shaft extending from said second surface of said latch body;

a latch plate formed with a notch which is adapted to capture a pin when in a latched position and to release the pin when in an unlatched position, said latch plate being formed with at least one gear tooth, said latch plate being mounted to said first spring-biased shaft which is effective to urge said latch plate toward said unlatched position;

a second spring-biased shaft extending from said second surface of said latch body and being spaced from said first spring-biased shaft;

an actuator formed with a first end, a second end, a side edge extending between said first and second ends and a locking pawl located opposite said side edge, said actuator being mounted to said second spring-biased shaft at a location between said first and second ends thereof, said second spring-biased shaft being effective to urge said actuator to a first position wherein said locking pawl engages said at least one gear tooth of said latch plate to retain said latch plate in said latched position;

a pin pivotally mounted to said latch body;

a pivot arm fixed to and pivotal with said pin, said pivot arm extending outwardly from said pin into engagement with said side edge of said actuator at a location between said second spring-biased shaft and said second end of said actuator, said pivot arm being oriented substantially perpendicularly to said side edge of said actuator;

a handle having a first end and a second end spaced from said first end, said second end of said handle being fixed to said pin, said first end of said handle being pulled outwardly in a direction away from said first surface of said latch body to initiate movement of said latch plate to said unlatched position, said outward movement of said first end of said handle causing said pin to rotate so that said pivot arm pivots said actuator about said second spring-biased shaft, said pivot arm being operative to overcome the spring force exerted by said second spring-biased shaft and to urge said actuator to a second position wherein said locking pawl disengages said at least one gear tooth allowing said latch plate to move to said unlatched position in response to the spring force applied thereto by said first spring-biased shaft.

2. The latch mechanism of claim 1 further including a key cylinder having an inner end and an outer end connected to said first end of said handle, said key cylinder extending through said latch body between spaced posts, said inner end of said key cylinder mounting a locking plate, said key cylinder being movable to a locked position wherein said locking plate engages said posts, said key cylinder being movable to an unlocked position wherein said locking plate disengages said posts to permit movement of said handle outwardly in a direction away from said first surface of said latch body.

3. The latch mechanism of claim 1 in which said space between said first and second ends of said handle provides a mechanical advantage in the course of movement of said handle outwardly from said first surface of said latch body thereby reducing the force required to rotate said pin and said pivot arm.

* * * * *